US008345948B2

(12) United States Patent
Zarembski et al.

(10) Patent No.: US 8,345,948 B2
(45) Date of Patent: Jan. 1, 2013

(54) AUTOMATED TURNOUT INSPECTION

(75) Inventors: Allan M. Zarembski, Cherry Hill, NJ (US); Todd L. Euston, Philadelphia, PA (US); Joseph W. Palese, Sewell, NJ (US)

(73) Assignee: Harsco Corporation, Camp Hill, PA (US)

( * ) Notice: Subject to any disclaimer, the term of this patent is extended or adjusted under 35 U.S.C. 154(b) by 685 days.

(21) Appl. No.: 12/557,806

(22) Filed: Sep. 11, 2009

(65) Prior Publication Data

US 2011/0064273 A1 Mar. 17, 2011

(51) Int. Cl.
*G06K 9/00* (2006.01)

(52) U.S. Cl. ..... 382/141

(58) Field of Classification Search ..... 382/141, 382/152

See application file for complete search history.

(56) References Cited

U.S. PATENT DOCUMENTS

| | | | | |
|---|---|---|---|---|
| 3,619,065 | A * | 11/1971 | Agnew | 356/604 |
| 4,198,164 | A * | 4/1980 | Cantor | 356/623 |
| 4,531,837 | A * | 7/1985 | Panetti | 356/608 |
| 4,915,504 | A * | 4/1990 | Thurston | 356/604 |
| 5,101,358 | A * | 3/1992 | Panetti | 700/179 |
| 5,134,808 | A * | 8/1992 | Panetti | 451/28 |
| 5,199,176 | A * | 4/1993 | Theurer et al. | 33/338 |
| 5,910,845 | A * | 6/1999 | Brown | 356/608 |
| 6,119,353 | A | 9/2000 | Gronskov | |
| 6,556,945 | B1 * | 4/2003 | Burggraf et al. | 702/159 |
| 7,036,232 | B2 * | 5/2006 | Casagrande | 33/1 Q |
| 7,389,694 | B1 | 6/2008 | Hay et al. | |
| 7,616,329 | B2 * | 11/2009 | Villar et al. | 356/625 |
| 7,659,972 | B2 * | 2/2010 | Magnus et al. | 356/237.1 |
| 7,755,660 | B2 * | 7/2010 | Nejikovsky et al. | 348/143 |
| 8,081,320 | B2 * | 12/2011 | Villar et al. | 356/606 |
| 8,180,590 | B2 * | 5/2012 | Szwilski et al. | 702/150 |
| 2004/0263624 | A1 * | 12/2004 | Nejikovsky et al. | 348/148 |

(Continued)

FOREIGN PATENT DOCUMENTS

| | | | |
|---|---|---|---|
| DE | 10040139 | A1 | 3/2002 |
| EP | 2165915 | A2 | 3/2010 |
| WO | 2006004846 | A2 | 1/2006 |

OTHER PUBLICATIONS

KLDLabs Inc., "Rail Measurement Technology", www.kldlabs.com/rail.html, accessed Dec. 2009.

*Primary Examiner* — Roy M Punnoose

(74) *Attorney, Agent, or Firm* — McNees Wallace & Nurick LLC

(57) ABSTRACT

A method of inspecting a turnout of a track includes the steps of: capturing images of the components of the turnout; converting each image into a set of coordinates that traces the transverse cross-section of a rail profile; analyzing the rail profile to determine if the rail profile is a profile of arunning rail portion or a component. Upon determination that the image represents a component, taking measurements of the rail profile and applying virtual gauges to the rail profile to check for potentially dangerous conditions of the component; and generating a summary of each cross-section of the rail profile of the component indicating problem areas. The method is used for identifying certain classes of switch or turnout rail conditions which can lead to derailments, and for enhancing the turnout inspection approach currently used. The use of this method as an integrated part of the rail profile monitoring program will reduce reliance on field measurements and will also allow more frequent, comprehensive, and convenient analysis of turnout condition.

20 Claims, 10 Drawing Sheets

U.S. PATENT DOCUMENTS

2006/0017911 A1* 1/2006 Villar et al. ..... 356/4.01
2009/0073428 A1 3/2009 Magnus et al.
2009/0112487 A1* 4/2009 Zhang et al. ..... 702/34
2009/0132179 A1 5/2009 Fu et al.
2009/0196486 A1 8/2009 Distante et al.
2009/0273788 A1* 11/2009 Nagle et al. ..... 356/445
2009/0319197 A1* 12/2009 Villar et al. ..... 702/34
2010/0007551 A1* 1/2010 Pagliuco et al. ..... 342/357.08
2010/0026551 A1* 2/2010 Szwilski et al. ..... 342/22

* cited by examiner

AUTOMATED TURNOUT INSPECTION

FIELD OF THE INVENTION

The present invention is directed to a system and a method for inspecting rail components of a railroad track, and in particular for inspecting the rail portion of turnouts, which include the switch points, stock rails, frog and closure rails.

BACKGROUND OF THE INVENTION

Maintaining proper conditions of rail components of a railroad track is of paramount importance in the railroad transportation industry. Rail components include joint bars, fasteners, switches, frogs, ties, ballast, etc., as well as the rail segments themselves which form the railroad track. The condition of the railroad track greatly impacts safety and reliability of rail transportation. Failure or degradation of various rail components of a railroad track can cause derailment of a train traveling on the track. Such derailment can cause significant property damage and injury to passengers, crew and bystanders.

Visual inspection is one way to monitor the condition of railroad track and to ensure that the track is in good condition. However, the quality of visual inspection is generally poor, especially when the visual inspection is performed from a hi-railer, which is a vehicle that has been modified to drive on railroad tracks. Such hi-railers are often used by an inspector to travel on the railroad track while simultaneously inspecting the railroad track.

The limitation of this prior art method of inspecting railroad components is that it is very difficult for the inspector to see small defects or damage in the railroad components while driving the hi-railer. This limitation is exacerbated by the fact that defects or damage to the rail portions of the turnouts, i.e. switch points, stock rails, frogs and closure rails, are especially difficult to see. Inspection that is performed on foot can provide better results, since the inspector can more closely and carefully inspect each of the rail components. However, inspection performed on foot is a slow and tedious process, requiring many hours to inspect several miles of railroad track.

U.S. Pat. No. 6,356,299 to Trosino et al. discloses an automated track inspection vehicle for inspecting a railroad track for various anomalies. The automated track inspection vehicle disclosed includes a self-propelled car equipped with cameras for creating images of the track. This reference discloses that a driver and an inspector visually inspect the track and right-of-way through a window in the vehicle, thereby identifying anomalies such as presence of weeds, blocked drain, improper ballast, missing clip, or defective tie. The reference further discloses that the images from the cameras are viewed by the inspector on a video terminal to detect anomalies on the railroad track. When anomalies are detected by the driver or the inspector, a signal is provided to store the video data for review by an analyst. The reference notes that the analyst reviews the stored video data to confirm the presence of an anomaly, and generates a track inspection report identifying the type and location of the anomaly, as well as the required remedial action.

The significant limitation of the inspection vehicle disclosed in Trosino et al. and the method taught therein requires the inspector to continually perform visual inspection of the railroad track while traveling on the railroad track, such inspection being not much better in quality than the conventional inspection method from a hi-railer noted above. The method taught also requires three trained individuals at the same time. In addition, the disclosed inspection vehicle requires the inspector to press an appropriate button, indicating the type of anomaly identified, in order for the vehicle to capture and store the images of the railroad track for review by the analyst.

If the inspector does not see the anomaly and/or push the appropriate button, no image that can be reviewed by the analyst is captured. Therefore, whereas the railcar vehicle of Trosino et al. is appropriate for inspecting a railroad track for large anomalies which are easily visible to the inspector, such as the presence of weeds, blocked drain, etc., the described inspection vehicle does not allow facilitated inspection of smaller rail components or smaller defects associated therewith. The reference further discloses that the inspection vehicle allows inspection of a railroad track at speeds of 30-50 miles per hour.

Other vehicle-based rail profile measurement systems are also known in the industry and are used to make large numbers of measurements of the rail head for evaluating the condition of the rail head of the running rails. When used for inspection or planning purposes, these rail head profile measurement systems are usually mounted on inspection vehicles, such as railroad track geometry inspection cars that can operate at high speed (80 plus mph or 125 kph) and record images every 5 to 20 feet (1.5 to 6 meters), depending on actual measurement speed.

This type of system allows rail wear information to be obtained on the running rails, together with the detailed rail profiles. Thus these rail head measurement systems provide information for planning of both rail-grinding and rail replacement (re-laying) activities.

There are currently several such optical- or laser-based systems that are commercially available and in active use. They generally follow the same principle, using a light source or laser to illuminate the rail head. The illuminated rail profile is then recorded by a CCD (charge-coupled device) camera or related recording device, and the image stored in a digitized format. The ORIAN system, distributed by KLD Labs, Inc., represents one such commercially available system that is used on both inspection vehicles and rail grinders. A second commercially available rail measuring system is the Laserail system, distributed by ImageMap, Inc., which is likewise used on both high-speed inspection vehicles and low-speed rail grinders. Other systems, such as the VISTA system, a product of Loram, Inc., are of more limited application, primarily on rail grinders.

While these systems all generate digitized rail head profiles for the running rails, the exact extent of the measured rail head is limited by the number of cameras used and the "shadow" of the rail heads themselves. Thus, in all cases, they do not get a complete rail head image but a full top-of-rail profile, parts of the side of the rail head, and portions of the rail web and base. The bottom of the rail head is almost always obscured and lost, as is the bottom of any lip on the rail head. This does, however, allow for sufficient information to be obtained to accurately monitor the profile of the rail head as well as obtain rail-wear information.

In addition, while these systems generate digitized rail head profiles for the running rails, they do not analyze or generate digitized profiles for switches, frogs or other such components of turnouts. The usefulness of such prior systems has been limited to running rails.

Therefore, in view of the above, there exists a need for a better system for inspecting rail components of a railroad track, and a method thereof. In particular, there still exists a need for a system and method that allow accurate and efficient inspection of the rail portion of turnouts, which include the switch point, stock rail, frog and closure rail.

SUMMARY OF THE INVENTION

One aspect of the invention is directed to a method of inspecting a turnout of a track. The method includes the steps of: capturing images of running rail portions and components of the turnout; converting each image into a set of coordinates that traces the transverse cross-section of a profile of the image of each respective running rail portion and each respective component; and analyzing the profile to determine if the profile is a profile of a running rail portion or a component. Upon determination that the profile of the image represents a component, measurements are taken of the profile and virtual gauges are applied to the profile to check for potentially dangerous conditions of the component; and a summary is generated of each cross-section of the profile of the component indicating problem areas.

Another aspect of the invention is directed to a method of inspecting a switch rail of a track. The method includes the steps of: capturing images of the switch rail; converting each image into a set of coordinates that traces the transverse cross-section of a profile of the switch rail; applying data analysis logic to check that the shape the profile of the switch rail is consistent with expected profile shapes of the switch rail; applying data quality filters to the coordinates to remove stray points, lines, and other extraneous (non-essential) data points captured in the image; overlaying the coordinates of an original section, such as a switch rail profile or of an original running rail profile, as a reference over the coordinates of the image; comparing measurements of the profile of the image of the switch rail to the profile of the original section; and electronically applying gauges to the shape of the profile of the switch rail. The measurements and the gauge readings are used to determine if the switch rail has wear issues and a summary is generated of each cross-section of the profile of the switch rail indicating problem areas.

Another aspect of the invention is directed to a method of inspecting a frog of a track. The method includes the steps of: capturing images of the frog; converting each image into a set of coordinates that traces the transverse cross-section of a profile of the frog; applying data analysis logic to check that the shape the profile of the frog is consistent with expected profile shapes of the frog; applying data quality filters to the coordinates to remove stray points, lines, and other extraneous (non-essential) data points captured in the image; setting the profile of the frog to a fixed reference point; comparing measurements of the profile of the image of the frog to an original frog section, such as an original profile of the frog; and electronically applying gauges to the shape of the profile of the frog. The measurements and the gauge readings are used to determine if the frog has wear issues and a summary is generated of each cross-section of the rail profile of the frog indicating problem areas.

Another aspect of the invention is directed to a method of inspecting a track. The method includes the steps of: capturing images of portions of a rail or other components; converting each image into a set of coordinates that traces the transverse cross-section of a profile of each respective image of the rail or other components; applying a virtual electronic gauge to each respective profile to check for potentially dangerous conditions of the rail; and generating a summary of each cross-section of the profile of the rail or other components indicating problem areas.

The methods disclosed herein are part of a system for identifying certain classes of switch or turnout rail conditions which can lead to derailments, and for enhancing the turnout inspection approach currently used. The use of this method as an integrated part of the rail profile monitoring program will reduce reliance on field measurements and will also allow more frequent, comprehensive, and convenient analysis of turnout condition.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
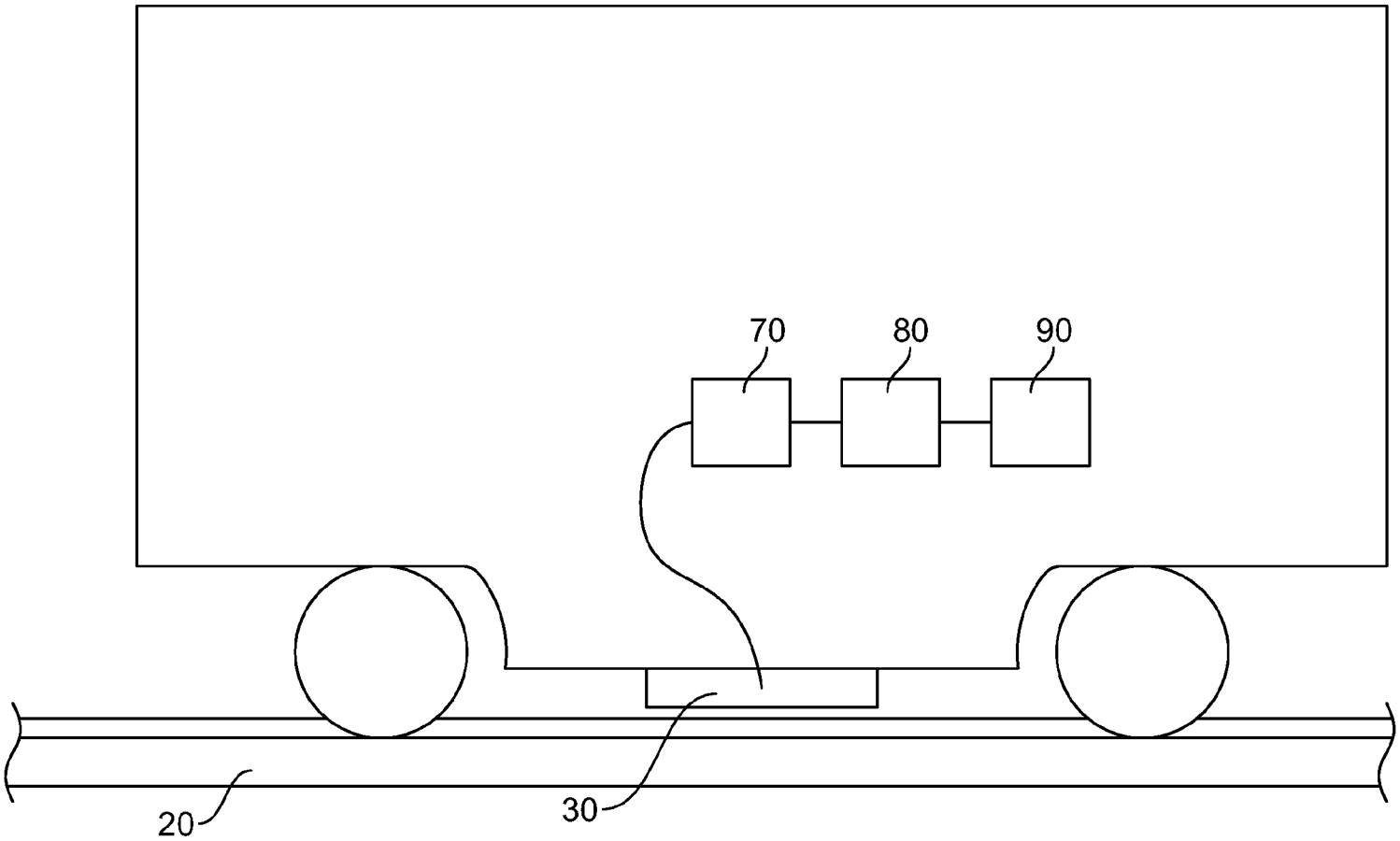
FIG. 1 is a schematic illustration of an inspection system used in accordance with the invention.

FIG. 1 shows an illustration of an inspection system 10 in accordance with one example embodiment of the present invention that facilitates inspection of rail components while traveling on the railroad track. As can be appreciated, only one side of a respective railroad track 20 is shown in FIG. 1. As will be evident from the discussion below, the inspection system 10 facilitates inspection of the rail portion of turnouts, which include, but are not limited to, the switch points, stock rails, frog and closure rails.

A turnout is a track device for diverting trains from the running track to other tracks. It represents an arrangement by which vehicles travel from one track to another. Two turnouts are used for the construction of a crossover. Turnouts, crossings, and other special track work are design "discontinuities" in the railroad track structure necessitated by the physical requirements for moving a rail vehicle from one track to another or for crossing tracks. They generally consist of more than two rails, usually with complex and expensive components such as switch points, frogs, and guard rails. Because these discontinuities generally contain changes in track geometry (often abrupt or nonuniform in nature), they result in the development of high force levels as the vehicle passes over this discontinuity. These high forces result in increased maintenance requirements and increased risk of derailment, both in main-line tracks and in yards.

Figure 2:
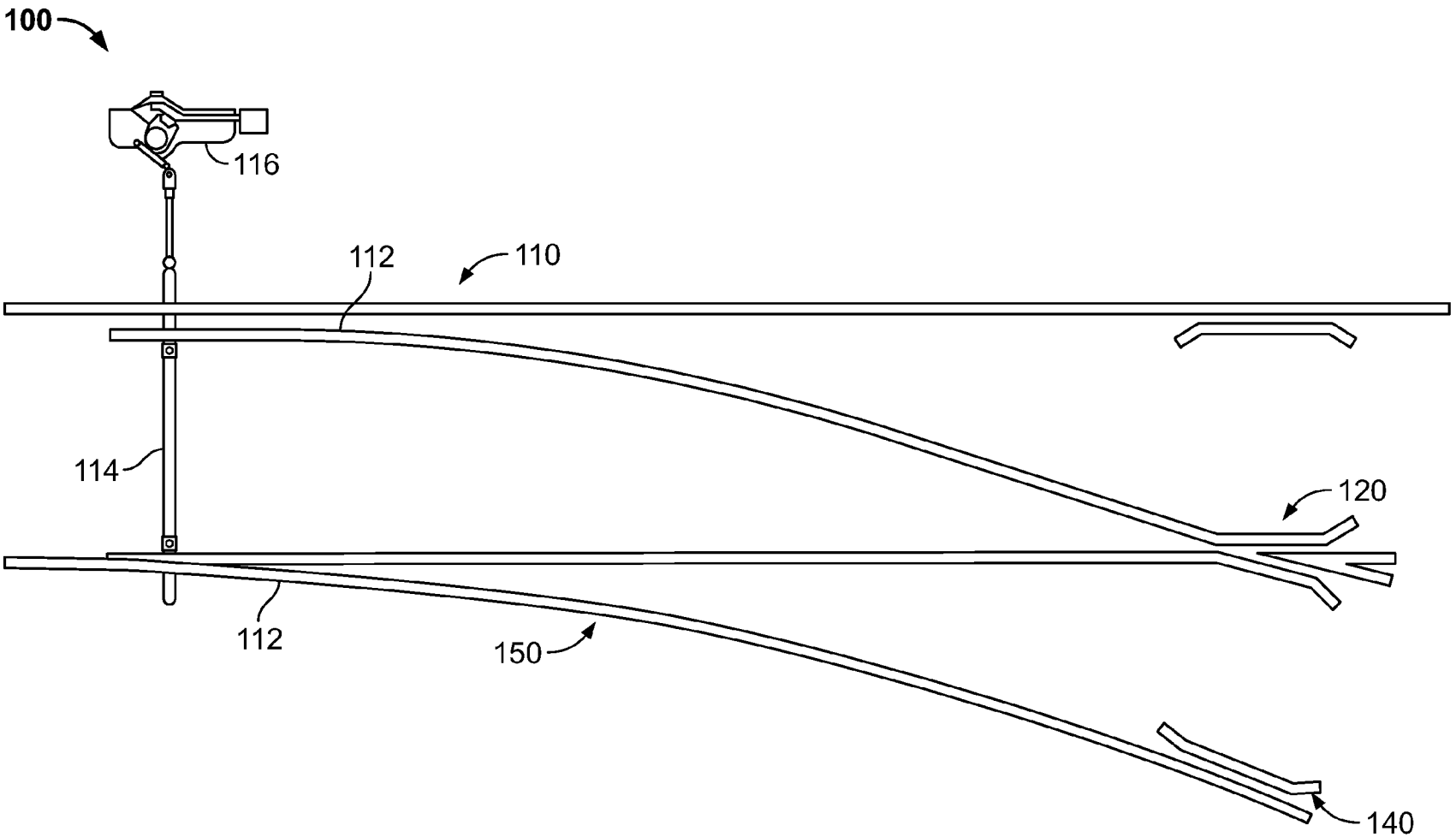
FIG. 2 is an overhead view of a turnout in a typical rail application.

FIG. 2 illustrates a typical, standard turnout 100. As can be seen, there is a complex arrangement of rails and special track components, including the switch 110 (FIG. 3), frog 120 or crossing (FIG. 4), guardrails 140, and other special track work components. The two principal parts of a turnout are the switch 110 and the frog 120, with a connecting piece of track 150 usually referred to as the lead. The rails connecting the switch with the frog in both the main-line and turnout sides are called closure rails.

Figure 3:
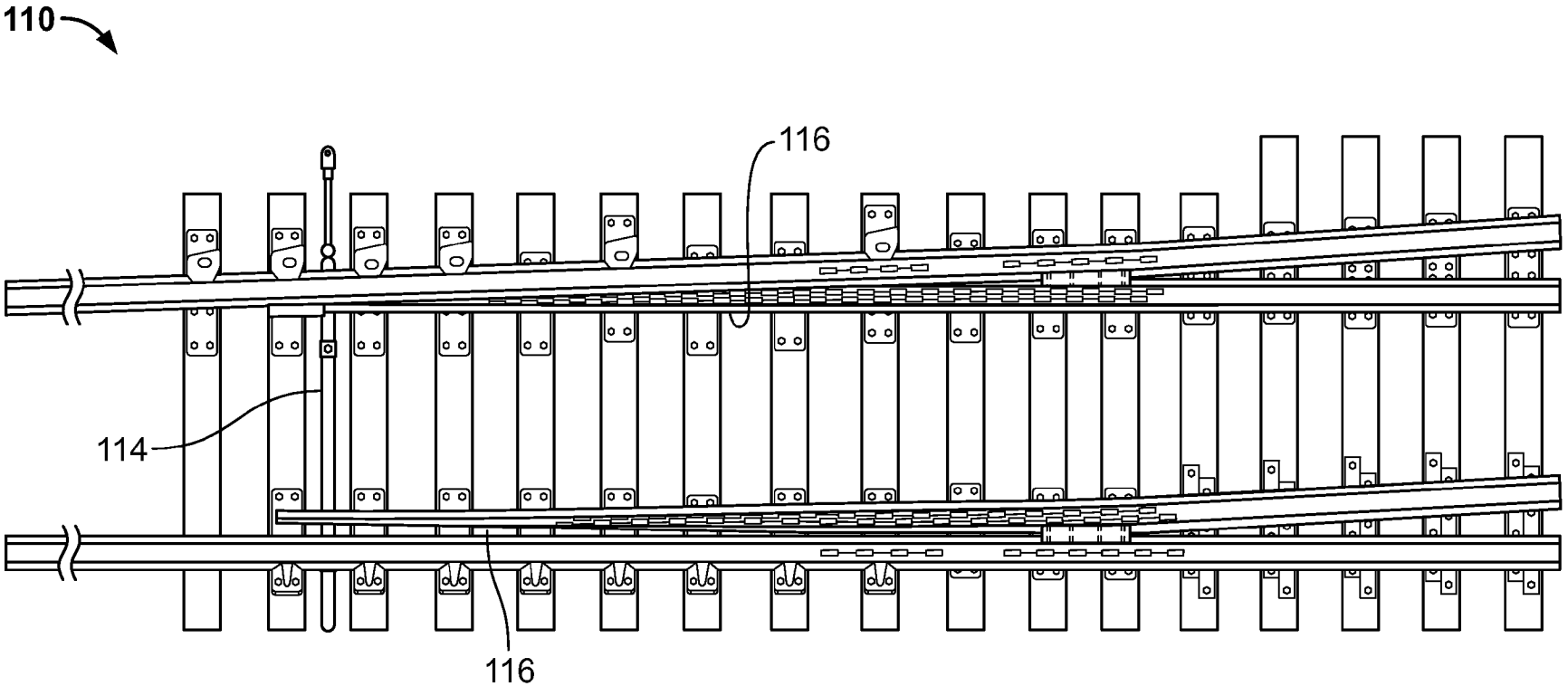
FIG. 3 is an enlarged overhead of a switch of the turnout of FIG. 2.

The switch 110, which is the part of the turnout 100 that actually shifts the vehicle from one track to the other, is the first part of the turnout 100 encountered by the vehicle in a facing move. The switch 110 consists of the switch rails or points 112, the switch rods 114, and the switch mechanism 116 itself (FIG. 3).

Figure 4:
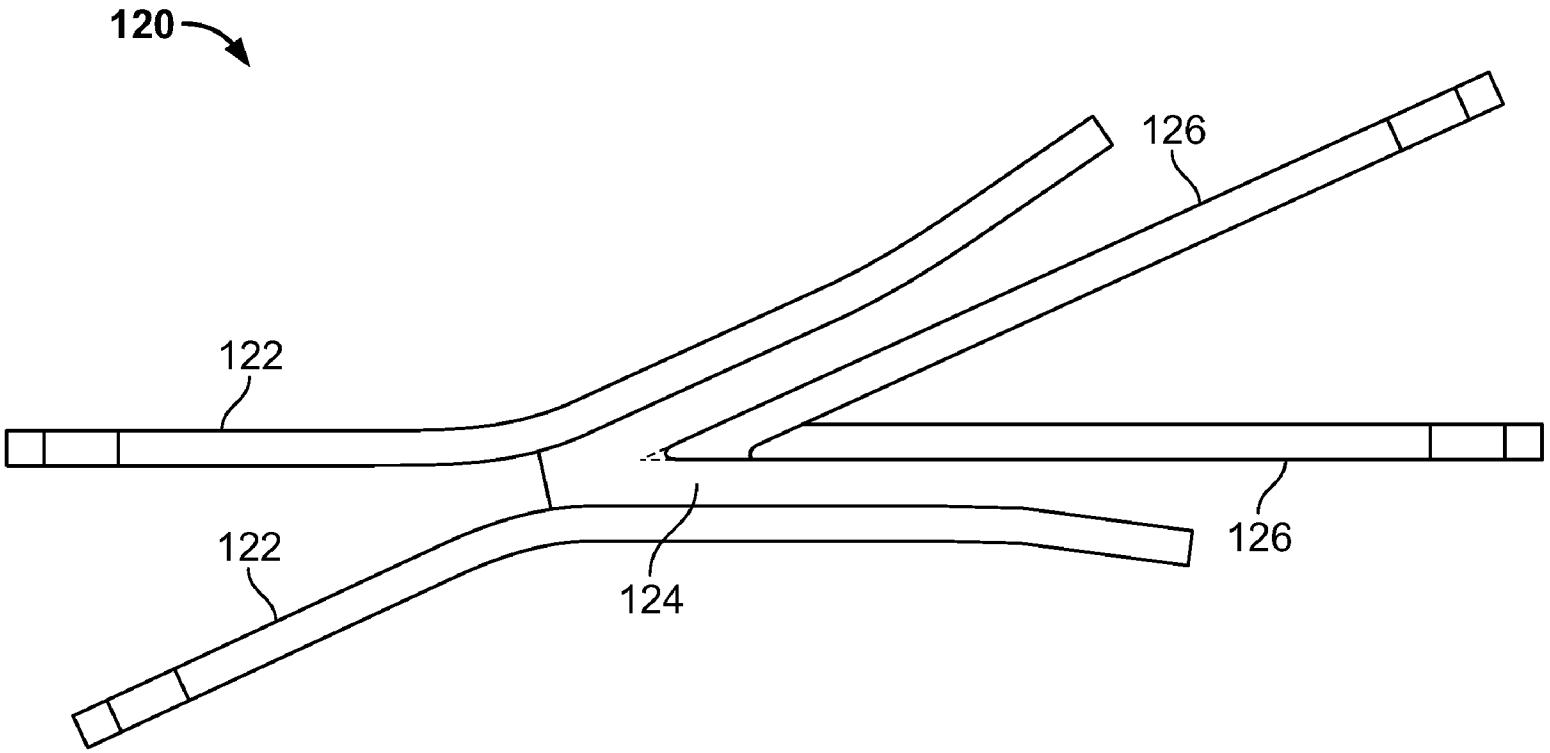
FIG. 4 is an enlarged overhead of a frog of the turnout of FIG. 2.

The frog 120 is the union of four rails that cross each other in such a manner that a flanged wheel rolling along either rail will have an unobstructed flangeway while passing the other rail. FIG. 4 illustrates the wing rails 122, the flangeway 124, and the point rails 126 of the frog.

The principal function of the turnout 100 is to cross the adjacent rails of the two tracks at the frog. A vehicle may then be switched from one track to the other by moving the free ends of the rails.

In North American the term "turnout" is used to describe the arrangement from the switch to the frog. However, in other countries the term "switch" can be used interchangeably for "turnout." There is also a difference in terminology associated with the frog, which is often referred to as a crossing in the United Kingdom, Europe, and elsewhere. In North American usage, a railway crossing is a location where two tracks or four rails cross, thus consisting of four frogs, while a road crossing is a location where the railroad tracks cross a road or highway.

As shown in the FIGS. 2-4, the physical characteristics of the track change (often abruptly) at a turnout 100. These characteristics, which include lateral geometry and both vertical and lateral stiffness, directly affect the quality of the "ride" through the turnout, and the associated dynamic interaction between the vehicle and the track. This later dynamic behavior is exemplified by particularly high lateral-force levels at the switch point 112 and at the frog 120. In a similar manner, high vertical forces are likewise recorded at these two locations, with the largest vertical impact usually occurring at the frog 120.

Because the turnout 100 "steers" the rail vehicle as it negotiates its key components, the relationship between the wheel and the rail is particularly important. Any degradation in this relationship, in any direction (vertical, lateral, or longitudinal), increases dynamic loading, the corresponding rate of degradation (maintenance), and the associated risk of failure (derailment). It is thus of key importance that this wheel-rail interface be optimally maintained within the turnout 100 or other special track work components 110, 120, 140. This is particularly true when instances of complex interlocking, such as multiple turnouts, are used.

Because of the complex geometry of the turnout and variations in the turnout structure, with its resulting changes in vertical and lateral stiffness, rail vehicles impose a level of loading on the turnout that is generally much more severe than that experienced by normal track. This, in turn, leads to a more rapid rate of degradation within the turnout. This degradation takes several forms which include: degradation of the running surface of the turnout and its major components; degradation of the geometry of the turnout; and degradation of the key turnout components.

Usually these forms of degradation will occur simultaneously, as the rate of degradation is interrelated with the development of surface defects, such as batter or corrugations (which cause increased dynamic loading and accelerated rates of geometry degradation and component failure). Among the specific modes of failure that can occur in turnouts, railway crossings, and other special track work are: surface batter, particularly in the area of the frogs and switch points; corrugations, particularly in the curved closure rails and the stock rail behind the guardrail; plastic flow and development of a lip on the switch rail, stock rail, closure rail, frog and wing rail (in the latter cases this can result in interference with the flangeway clearance); deterioration in wheel-rail contact through the turnout, particularly in the diverging direction; deterioration in vertical geometry; deterioration in lateral geometry, to include widening of gage through the diverging direction, widening of guardrail gage, etc.; deterioration of switch ties; and deterioration of fasteners, shims, blocks, and other components.

In all of the above cases, the effect of the deterioration is generally to increase the level of wheel-rail forces within the turnout, and to further increase the rate of degradation. As a result, component life for special track work components is significantly shorter (in some cases one tenth that of normal track component life), and corresponding special track work maintenance costs are significantly higher. In fact, one study showed that turnout maintenance costs are 10 to 13 times that of normal track, on a per foot basis.

Referring again to FIG. 1, the inspection system 10 of the illustrated embodiment includes a high-resolution image capturing system 30, a trigger generator 70, and a computer 80. The computer has an image interface device and a counter/timer device integrated therein. Alternatively, the interface device and counter/timer device may be separate devices.

The computer 80 of the illustrated embodiment has a processor and memory (not shown), for processing and storing data and instructions associated with the control and function of the interface device and the counter/timer device, and to further store the images of the rail components.

The video inspection system 10 shown also includes a Global Positioning System (GPS) receiver 90 that allows determination and monitoring of the position of the vehicle or railcar on which the inspection system 10 is implemented. The GPS is provided on the vehicle or railcar that rides on the rails 20, and thus, can be utilized to identify the position associated with each image.

Figure 5:
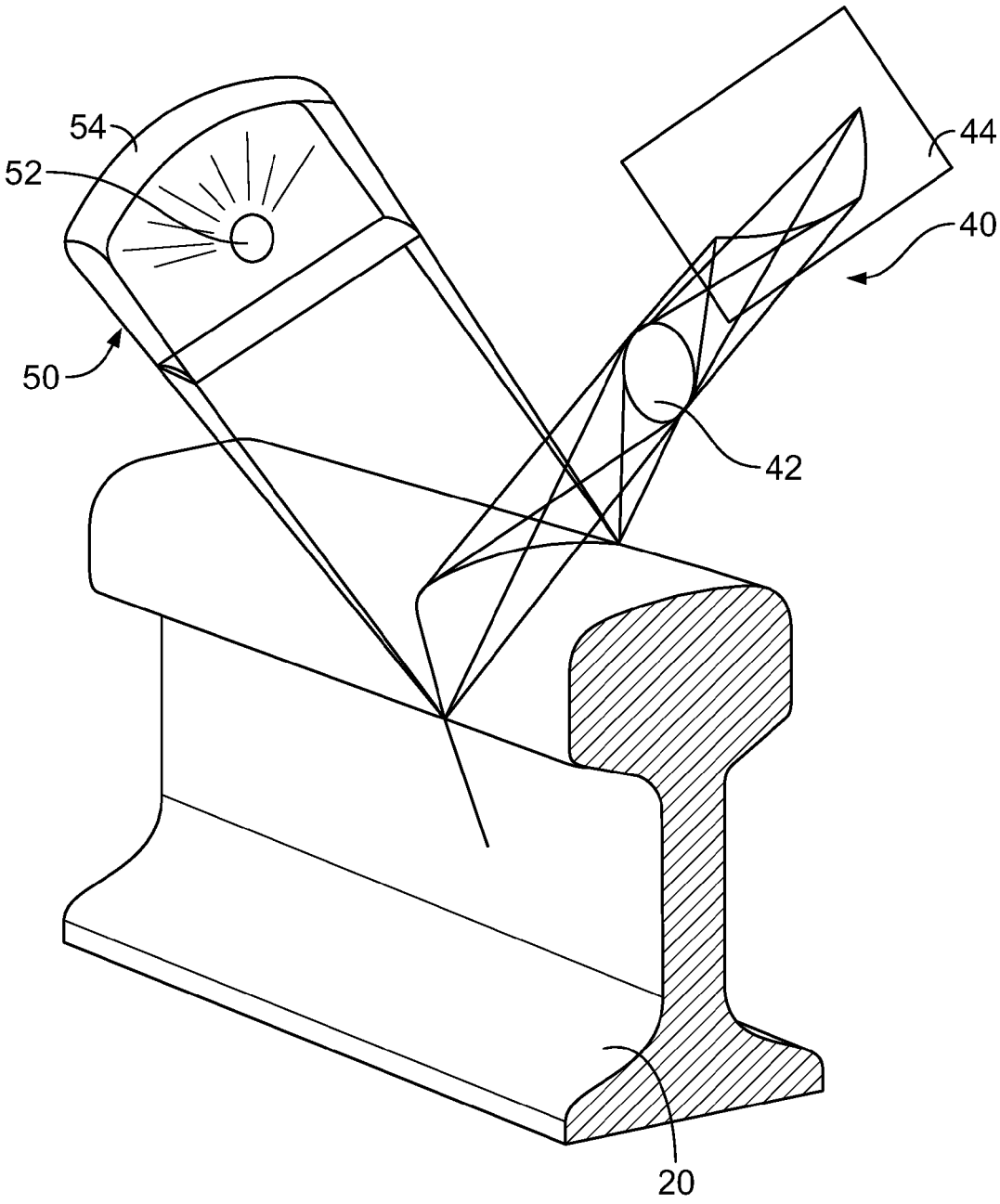
FIG. 5 is a schematic illustration of a portion of the rail profile measurement system.

FIG. 5 shows a more detailed schematic arrangement of various components of the high-resolution image projection or capturing system 30 of the inspection system which are mounted on a frame member of a vehicle or railcar. The high-resolution image capturing system 30 has an image projector 40 and light source 50 which may be secured to the frame member or other component of the vehicle or railcar in any appropriate manner using brackets, fasteners and/or other securing hardware. FIG. 5 shows a cross-sectional view of a generic rail section 20 (extending into and out of the page) with the light source 50 and image projector 40 being positioned at a slight angle and elevated relative to the rail 20 of the railroad track. In the embodiment shown, the image projector 40 has a field lens 42 and a recording surface 44. The light source 50 has a flash 52 and a parabolic reflector 54.

Although other systems are possible, in the embodiment shown, an Optical Rail Inspection and Analysis system made by KLD Labs is shown and incorporated herein by reference. One example of such system manufactured by KLD Labs uses four near-infrared diode lasers to illuminate the left and right side of each rail. A high-resolution image projector then records an image of the rails using charge-coupled devices.

In order to acquire the images that are provided by the image projector 30, the image projector 30 is electronically connected to the camera interface device, which may be implemented as a frame grabber. The camera interface device captures the images provided by the image projector 30 for storage in memory of the computer 80.

Referring again to FIG. 1, the sensor 40 is electronically connected to the trigger generator 70 of the video monitoring system 10. The trigger generator 70 is implemented to receive the signal from the sensor 40, and generate a trigger signal to the interface device described above so that the interface device captures the images provided by the image projector 30 in response to the trigger signal. In other words, the sensor 40 provides a signal to the trigger generator 70 when the sensor 40 detects the turnout 100 or other special component, and the trigger generator 70 provides a trigger signal to the interface device which captures the image provided by the image projector 30. This is one embodiment to capture the images. Other mechanisms to detect the turnout 100 and trigger the trigger generator 70 can be used without departing from the scope of the invention.

Figure 6:
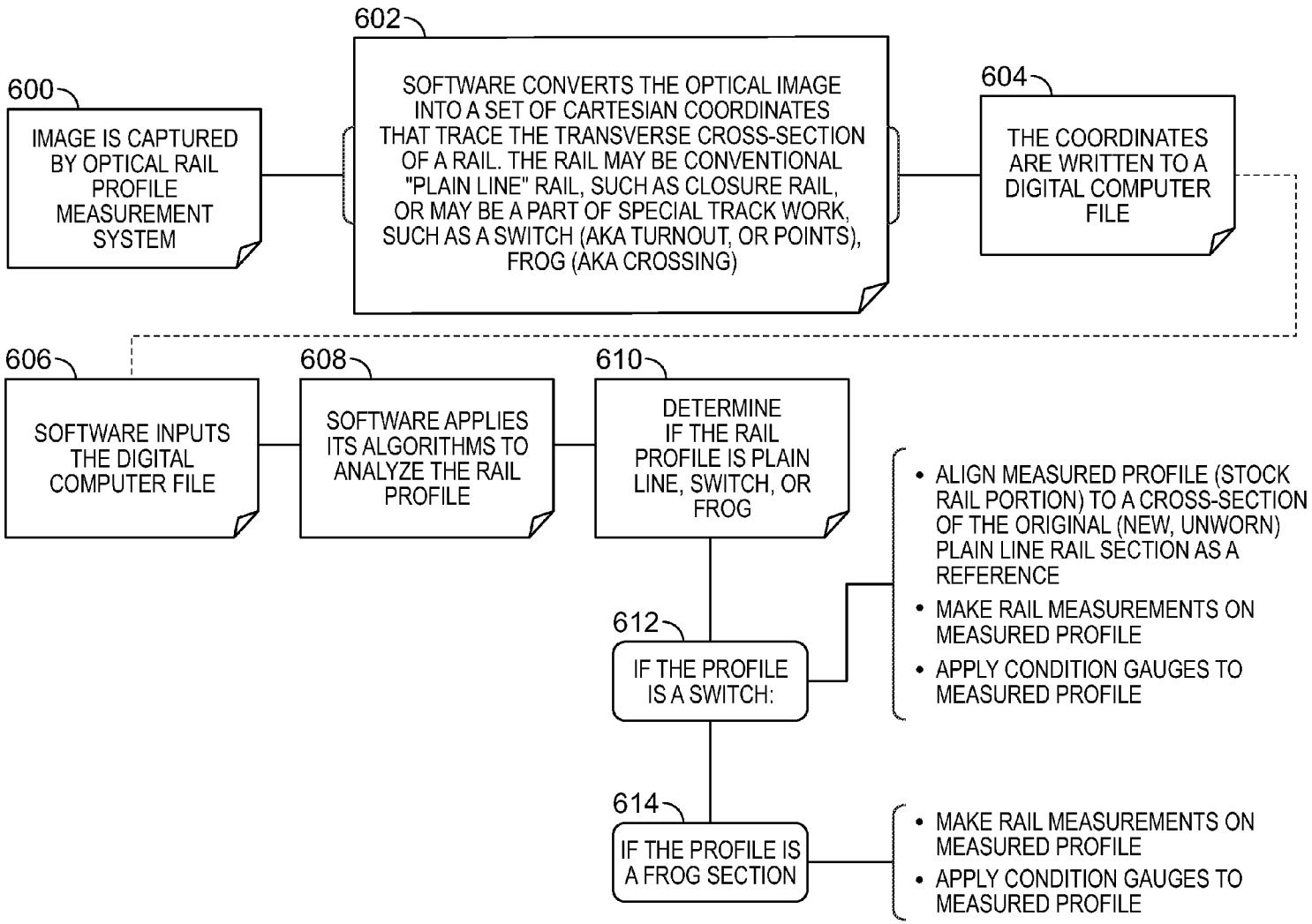
FIG. 6 is a block diagram illustrating the method of inspecting rail components of the turnout offline.

Referring to FIG. 6, a flowchart is shown depicting the steps of the methodology and software used to inspect or analyze the turnout or other special components offline. As shown in box 600, images of the component are captured using the type of known components described above. One such example of this type of system is the KLD Labs Orian system. Although other intervals are possible, the images are captured at one inch (1") intervals at a speed of eight miles per hour (8 mph). Alternatively, depending on the detail needed, the images may be captured at three inch (3") intervals at twenty-five miles per hour (25 mph). Depending upon the technology used, these images may be captured at various speeds (usually above 5 mph) and various intervals (usually less than six inches). The captured images of the cross-section of the rail of the component are converted into a set of Cartesian coordinates that traces the transverse cross-sections of the respective rail, box 602. The rail of the component may be conventional "running" rail, such as closure rail, or may be a part of a special component, such as a switch, frog, etc. The location or coordinates associated with the each respective captured image are obtained from the GPS unit and written to a digital computer file, box 604. This allows each respective image and its respective Cartesian coordinates to be identified to a specific and exact location of the track.

Referring to box 606, the image, converted and saved electronically to a file associated with the location of the image, is then inputted into the program or software. As represented in boxes 608, 610, the program first determines if the rail profile is a profile of a running rail, a closed or open switch rail or a frog section. If the profile is of a running rail, also known as a Tee Rail or plain line rail, the program may apply virtual gauges to the running rail to determine if safety or maintenance issues are present.

If the program determines that the profile is a switch, box 612, the program either aligns the measured profile (stock rail portion) to a cross-section of the original profile of the switch (new, unworn) or a cross-section of the original (new, unworn) running rail section as a reference. If the switch is in the closed position, the original profile applied is the entire cross-section of a new, unworn closed switch rail section. The original profile of the switch can be taken from the original engineering drawings of the switch or may be compared to an image of the profile of the switch taken when the switch is originally installed. The use of the GPS with this system allows for precise and accurate comparisons of the profiles. Virtual gauges are applied to the measured profile to check for potentially dangerous conditions of the switch. A more detailed explanation of the switch profile analysis is provided below with respect to FIG. 8 for an open switch and FIG. 9 for a closed switch. The program uses the measurements and the gauges to determine if safety or maintenance issues are present. The program will generate a summary and report of each cross-section indicating problem areas. In one embodiment, a visual image will be displayed showing areas with safety issues in red and maintenance issues in yellow.

If the program determines that the profile is a frog section, box 614, the program aligns the measured profile (stock rail portion) to a cross-section of the original profile of the frog (new, unworn) section as a reference. The original profile of the frog can be taken from the original engineering drawings of the frog or may be compared to an image of the profile of the frog taken when the frog is originally installed. The use of the GPS with this system allows for precise and accurate comparisons of the profiles. Virtual gauges are applied to the measured profile to check for potentially dangerous conditions of the frog section. The program uses the measurements and the gauges to determine if safety or maintenance issues are present. A more detailed explanation of the frog profile analysis is provided below with respect to FIG. 10. The program will generate a summary and report of each cross-section indicating problem areas. In one embodiment, a visual image will be displayed showing areas with safety issues in red and maintenance issues in yellow.

Applying the virtual gauges, which may match current measurement inspection gauges, and making other key rail-related measurements of the switch rail and frog, has proven to be an effective way to evaluate the condition of switches and frogs. This is especially important, since there are a large number of hazardous conditions near a switch point that could result in a train derailment. This inspection and analysis enables a large number of switches and frogs to be measured in the field, analyzed, reported and made available for follow-up viewing in an office setting. Individual profiles of the switches, frogs and other special components can be evaluated with each of the virtual gauges, and images of the profiles overlaid with the gauges can be saved. The series of profiles constituting a switch or frog can be drawn together to approximate a 3-dimensional view of the switch or frog, which allows a more comprehensive view of the turnout and how its condition varies along the closed switch blade. In addition, measuring the same switches and frogs regularly will allow the deterioration of the switches and frogs to be monitored closely, providing a means to perform proactive, rather than reactive, maintenance on the turnout.

Figure 7:
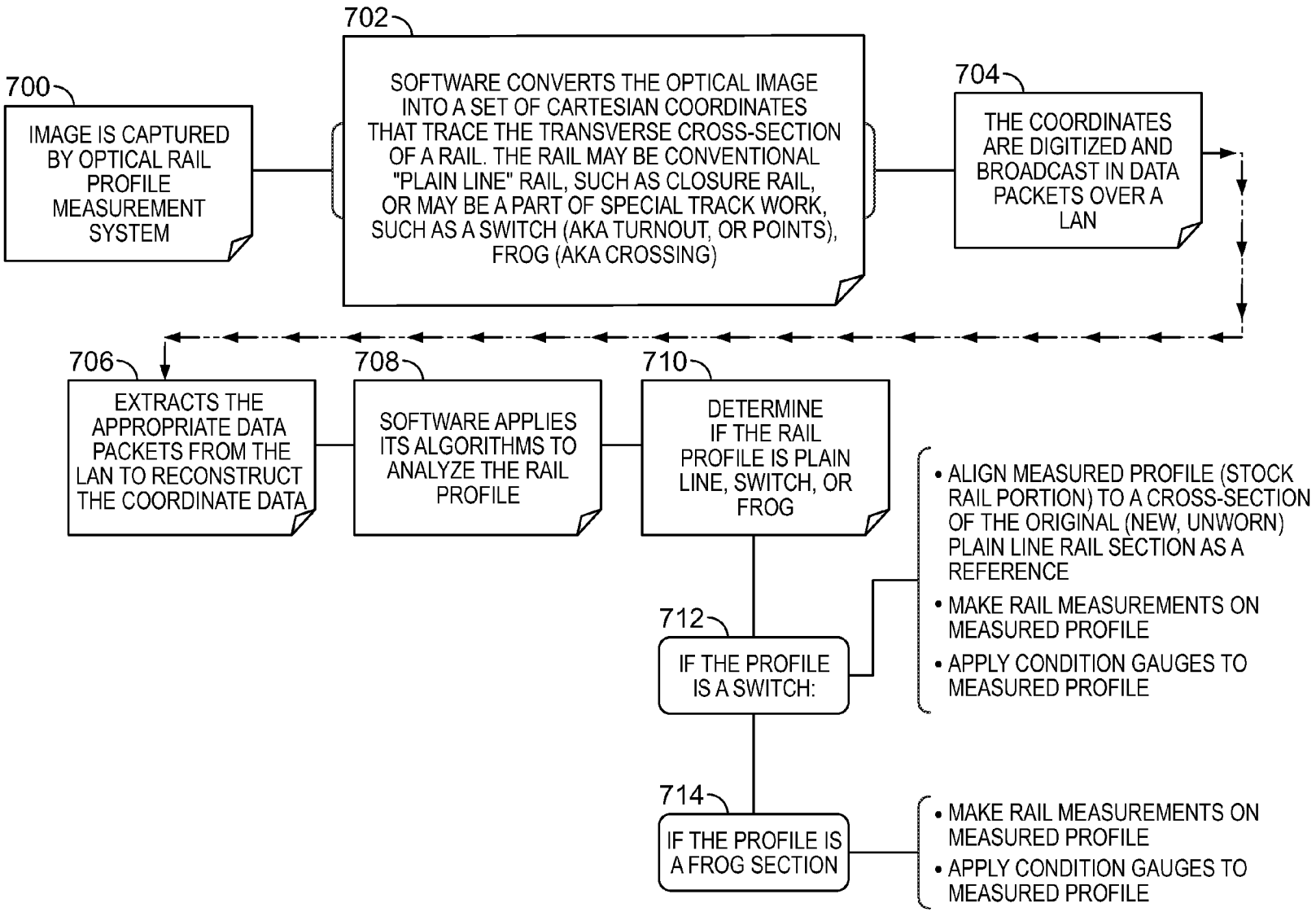
FIG. 7 is a block diagram illustrating the method of inspecting rail components of the turnout using a real-time, on board analysis.

Referring to FIG. 7, a flowchart is shown depicting the steps of the methodology and software used to inspect or analyze the turnout or other special components online or in real-time. As shown in box 700, Images of the component are captured using the type of known components described above. One example of this type of system is the KLD Labs Orian system. Although other intervals are possible, the images are captured at one inch (1") intervals at a speed of eight miles per hour (8 mph). Alternatively, depending on the detail needed, the images may be captured at three inch (3") intervals at twenty-five miles per hour (25 mph). The captured images of the cross-section of the rail of the component are converted into a set of Cartesian coordinates that traces the transverse cross-sections of the respective rail, box 702. The rail of the component may be conventional "running" rail, such as closure rail, or may be a part of a special component, such as a switch, frog, etc. The location or coordinates associated with each respective captured image are obtained from the GPS unit and written to a digital computer file, box 704. This allows each respective image and its respective Cartesian coordinates to be identified to a specific and exact location of the track.

Referring to box 706, the coordinates are digitized and broadcast in data packets over a local area network (LAN) or the like. This allows the data packets to be analyzed on board the rail car in real-time, providing an operator with real-time data regarding the profile of the turnout or other special components. The program extracts the appropriate data packets from the LAN to reconstruct the coordinate data. As represented in boxes 708, 710, the program first determines if the rail profile is a profile of a running rail, a switch rail or a frog. If the profile is of a running rail, the program may apply virtual gauges to the running rail to determine if safety or maintenance issues are present.

If the program determines that the profile is a switch rail, box 712, the program either aligns the measured profile (stock rail portion) to a cross-section of the original profile of the switch (new, unworn) or a cross-section of the original (new, unworn) running rail section as a reference. If the switch is in the closed position, the original profile applied is the entire cross-section of a new, unworn closed switch rail section. The original profile of the switch can be taken from the original engineering drawings of the switch or may be compared to an image of the profile of the switch taken when the switch is originally installed. The use of the GPS with this system allows for precise and accurate comparisons of the profiles. Virtual gauges are applied to the measured profile to check for potentially dangerous conditions of the switch. A more detailed explanation of the switch profile analysis is provided below with respect to FIG. 8 for an open switch and FIG. 9 for a closed switch. The program uses the measurements and the gauges to determine if safety or maintenance issues are present. The program will generate a real-time summary of each cross-section indicating problem areas. In one embodiment, a visual image will be displayed showing areas with safety issues in red and maintenance issues in yellow.

If the program determines that the profile is a frog section, box 714, the program aligns the measured profile to a cross-section of the original profile of the frog (new, unworn) section as a reference. The original profile of the frog can be taken from the original engineering drawings of the frog or may be compared to an image of the profile of the frog taken when the frog is originally installed. The use of the GPS with this system allows for precise and accurate comparisons of the profiles. Virtual gauges are applied to the measured profile to check for potentially dangerous conditions of the frog section. The program uses the measurements and the gauges to determine if safety or maintenance issues are present. A more detailed explanation of the frog profile analysis is provided below with respect to FIG. 10. The program will generate a real-time summary of each cross-section indicating problem areas. In one embodiment, a visual image will be displayed showing areas with safety issues in red and maintenance issues in yellow.

As previously described, applying the virtual gauges, which may match current measurement inspection gauges, and making other key rail-related measurements of the switch rail and frog, has proven to be an effective way to evaluate the condition of switches and frogs. This is especially important, since there are a large number of hazardous conditions near a switch point that could result in a train derailment. This inspection and analysis enables a large number of switches and frogs to be measured in the field, analyzed, reported and made available for follow-up viewing in an office setting. Individual rail profiles can be evaluated with each of the virtual gauges, and images of the rail overlaid with the gauges can be saved. The series of profiles constituting a switch or frog can be drawn together to approximate a 3-dimensional view of the switch or frog, which allows a more comprehensive view of the turnout and how its condition varies along the closed switch blade. In addition, measuring the same switches and frogs regularly will allow the deterioration of the switches and frogs to be monitored closely, providing a means to perform proactive, rather than reactive, maintenance on the turnout.

Figure 8:
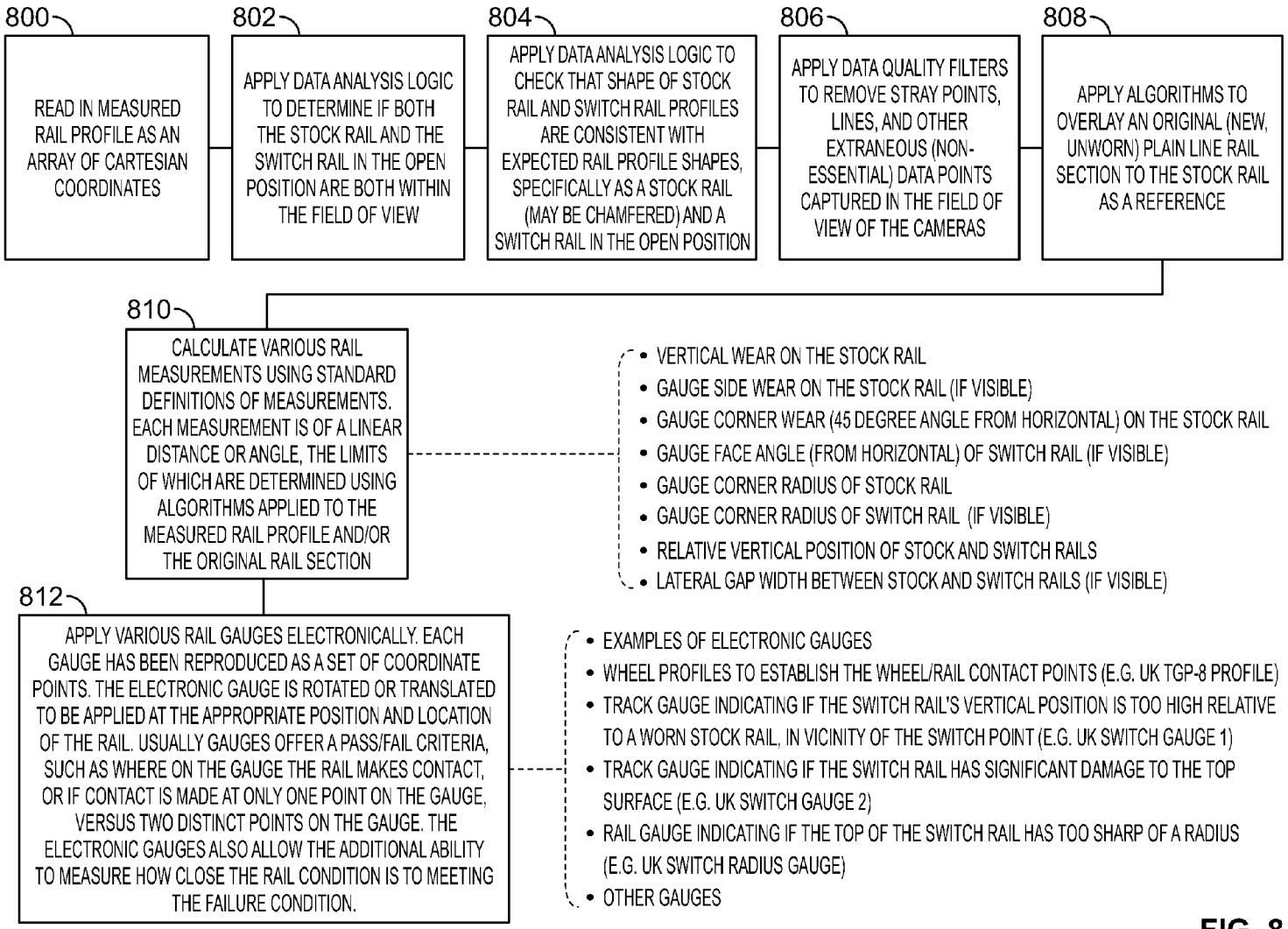
FIG. 8 is a block diagram illustrating a switch profile analysis, when switch rail is in open position.

Referring to FIG. 8, a flowchart is shown depicting the steps of the methodology and software used to inspect or analyze the profile of a switch when the switch rail is in an open position from the stock rail. As previously described, the Cartesian coordinates of the image are inputted into the program, box 800. The software applies data analysis logic to determine if both the stock rail and the switch rail in the open position are both within the field of view, box 802. The software also applied data analysis logic to check that the shape of stock rail and switch rail profiles are consistent with expected rail profile shapes, specifically as a stock rail and switch rail in the open position, box 804. The stock rail may or may not be chamfered. If the analysis confirms that the switch is in the open position, data quality filters are applied to the Cartesian coordinates to remove stray points, lines, and other extraneous (non-essential) data points captured in the field of view of the cameras, box 806. Algorithms are applied to overlay an original (new, unworn) running rail section to the stock rail and an original (new, unworn) switch rail section to the switch rail as references, box 808.

As represented in box 810, various rail measurements are calculated using standard definitions of measurements. Each measurement is of a linear distance or angle, the limits of which are determined using algorithms applied to the measured rail profile and/or the original rail section. The measurements are used to determine various characteristics, including, but not limited to, any or all of the following:

a) Vertical wear on the stock rail;
b) Gauge side wear on the stock rail (if visible);
c) Gauge corner wear (45 degree angle from horizontal) on the stock rail;
d) Gauge face angle (from horizontal) of switch rail (if visible);
e) Gauge corner radius of stock rail;
f) Gauge corner radius of switch rail (if visible);
g) Relative vertical position of stock and switch rails; and
h) Lateral gap width between stock and switch rails (if visible).

As represented in box 812, various rail gauges are applied electronically to the shape of the rail profile. Each gauge has been reproduced as a set of coordinate points. The electronic gauge is rotated or translated to be applied at the appropriate position and location of the rail. Typically, prior art gauges offer a pass/fail criterion, such as where on the gauge the rail makes contact, or if contact is made at only one point on the gauge, versus two distinct points on the gauge. However, the electronic gauges of this invention also allow the additional ability to measure how close the rail condition is to meeting the failure condition. Examples of the electronic gauges used include, but are not limited to:

a) Wheel profiles to establish the wheel/rail contact points (e.g. UK TGP-8 profile);
b) Track gauge indicating if the switch rail's vertical position is too high relative to a worn stock rail, in vicinity of the switch point (e.g. UK Switch Gauge 1);
c) Track gauge indicating if the switch rail has significant damage to the top surface (e.g. UK Switch Gauge 2); and
d) Rail gauge indicating if the top of the switch rail has too sharp a radius (e.g. UK Switch Radius Gauge).

As has been previously described, the program uses the measurements and the gauges to determine if safety or maintenance issues are present. The program will generate a summary and report of each cross-section indicating problem areas. In one embodiment, a visual image will be displayed showing areas with safety issues in red and maintenance issues in yellow.

Figure 9:
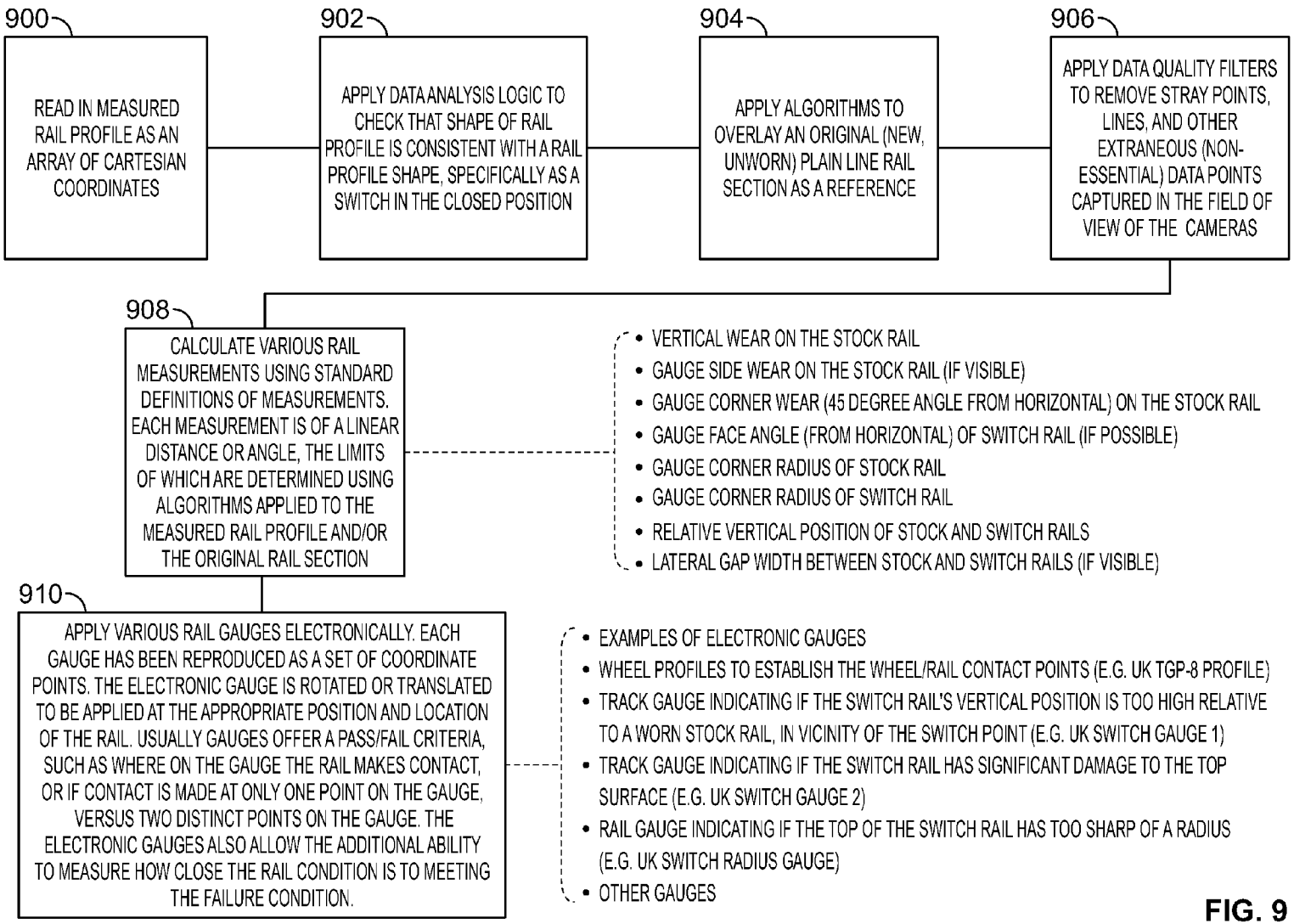
FIG. 9 is a block diagram illustrating a switch profile analysis, when switch rail is in closed position against a stock rail.

Referring to FIG. 9, a flowchart is shown depicting the steps of the methodology and software used to inspect or analyze the profile of a switch when the switch rail is in a closed position against the stock rail. As previously described, the Cartesian coordinates of the image are inputted into the program, box 900. The software applies data analysis logic to check that the shape of rail profile is consistent with a rail profile shape, specifically as a switch in the closed position, box 902. If the analysis confirms that the switch is in the closed position, data quality filters are applied to the Cartesian coordinates to remove stray points, lines, and other extraneous (non-essential) data points captured in the field of view of the cameras, box 906. Algorithms are applied to overlay an original (new, unworn) running rail section or a cross-section of the original profile of the entire cross-section of a new, unworn closed switch rail section as a reference, box 904.

As represented in box 908, various rail measurements are calculated using standard definitions of measurements. Each measurement is of a linear distance or angle, the limits of which are determined using algorithms applied to the measured rail profile and/or the original rail section. The measurements are used to determine various characteristics, including, but not limited to, any or all of the following:

a) Vertical wear on the stock rail;
b) Gauge side wear on the stock rail (if visible);
c) Gauge corner wear (45 degree angle from horizontal) on the stock rail;
d) Gauge face angle (from horizontal) of switch rail (if possible)
e) Gauge corner radius of stock rail;
f) Gauge corner radius of switch rail;
g) Relative vertical position of stock and switch rails; and
h) Lateral gap width between stock and switch rails (if visible).

As represented in box 910, various rail gauges are applied electronically to the shape of the rail profile. Each gauge has been reproduced as a set of coordinate points. The electronic gauge is rotated or translated to be applied at the appropriate position and location of the rail. Typically, prior art gauges offer a pass/fail criterion, such as where on the gauge the rail makes contact, or if contact is made at only one point on the gauge, versus two distinct points on the gauge. However, the electronic gauges of this invention also allow the additional ability to measure how close the rail condition is to meeting the failure condition. Examples of the electronic gauges used include, but are not limited to:

a) Wheel profiles to establish the wheel/rail contact points (e.g. UK TGP-8 profile);
b) Track gauge indicating if the switch rail's vertical position is too high relative to a worn stock rail, in vicinity of the switch point (e.g. UK Switch Gauge 1);
c) Track gauge indicating if the switch rail has significant damage to the top surface (e.g. UK Switch Gauge 2); and
d) Rail gauge indicating if the top of the switch rail has too sharp a radius (e.g. UK Switch Radius Gauge).

As has been previously described, the program uses the measurements and the gauges to determine if safety or maintenance issues are present. The program will generate a summary and report of each cross-section indicating problem areas. In one embodiment, a visual image will be displayed showing areas with safety issues in red and maintenance issues in yellow.

Figure 10:
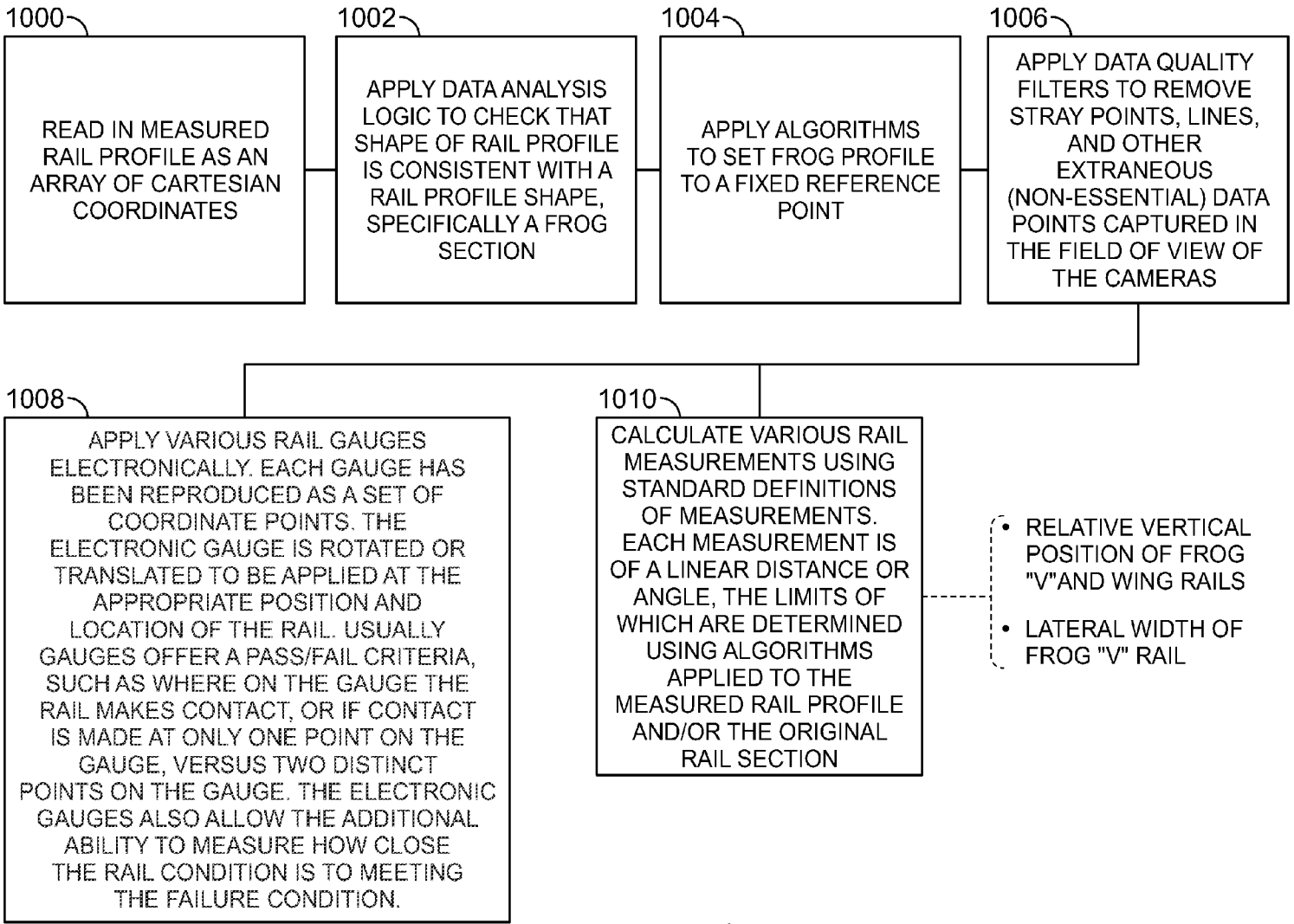
FIG. 10 is a block diagram illustrating a frog profile analysis.

Referring to FIG. 10, a flowchart is shown depicting the steps of the methodology and software used to inspect or analyze the profile of a frog. As previously described, the Cartesian coordinates of the image are inputted into the program, box 1000. The software applies data analysis logic to check that the shape of rail profile is consistent with a rail profile shape, specifically a frog section, box 1002. If the analysis confirms that the section is a frog section, the frog profile is set to a fixed reference point, box 1004. Data quality filters are applied to the Cartesian coordinates to remove stray points, lines, and other extraneous (non-essential) data points captured in the field of view of the cameras, box 1006.

As represented in box 1008, various rail measurements are calculated using standard definitions of measurements. Each measurement is of a linear distance or angle, the limits of which are determined using algorithms applied to the measured rail profile and/or the original rail section. The measurements are used to determine various characteristics, including, but not limited to, any or all of the following:

a) Relative vertical position of frog "V" and wing rails; and
b) Lateral width of frog "V" rail.

As represented in box 1010, various rail gauges are applied electronically to the shape of the rail profile. Each gauge has been reproduced as a set of coordinate points. The electronic gauge is rotated or translated to be applied at the appropriate position and location of the rail. Typically, prior art gauges offer a pass/fail criterion, such as where on the gauge the rail makes contact, or if contact is made at only one point on the gauge, versus two distinct points on the gauge. However, the electronic gauges of this invention also allow the additional ability to measure how close the rail condition is to meeting the failure condition or by how much it has exceeded the maintenance or failure criterion.

As has been previously described, the program uses the measurements and the gauges to determine if safety or maintenance issues are present. The program will generate a summary and report of each cross-section indicating problem areas. In one embodiment, a visual image will be displayed showing areas with safety issues in red and maintenance issues in yellow.

Because of the complex geometry of the turnout and variations in the turnout structure, with resulting changes in vertical and lateral stiffness, rail vehicles impose a level of loading on the turnout that is generally much more severe than that experienced by normal track. This, in turn, leads to a more rapid rate of degradation within the turnout. This degradation takes several forms which include: degradation of the running surface of the turnout and its major components; degradation of the geometry of the turnout and degradation of the key turnout components. Usually these forms of degradation will occur simultaneously because the rate of degradation is interrelated with the development of surface defects, such as batter or corrugations (which cause increased dynamic loading and accelerated rates of geometry degradation and component failure).

Among the specific modes of failure that can occur in turnouts, railway crossings, and other special track work components are:

a) Surface batter, particularly in the area of the frogs and switch points;
b) Corrugations, particularly in the curved closure rails and the stock rail behind the guardrail;

c) Plastic flow and development of lip on the switch rail, stock rail, closure rail, frog and wing rail (in the latter cases this can result in interference with the flangeway clearance);
d) Deterioration in wheel-rail contact through the turnout, particularly in the diverging direction;
e) Deterioration in vertical geometry;
f) Deterioration in lateral geometry, to include widening of gage through the diverging direction, widening of guardrail gage, etc.;
g) Deterioration of switch ties; and
h) Deterioration of fasteners, shims, blocks, and other components.

In all of the above cases, the effect of the deterioration is generally to increase the level of wheel-rail forces within the turnout, and to further increase the rate of degradation. As a result, component life for special track work components is significantly shorter (in some cases one tenth that of normal track component life), and corresponding special track work maintenance costs are significantly higher. In fact, one study showed that turnout maintenance costs are 10 to 13 times that of normal track, on a per foot basis.

One of the benefits of the method and software described is that a large volume of data can be processed in a relatively short amount of time with limited interaction required by a software user. The railhead profiles that are seen in and around a switch have certain features that could help distinguish them from other rejected rail profiles, such as, but not limited to: chamfered rail; a wider and deeper gauge face that has an angle of 60° to 80° from horizontal toward the switch point, versus the essentially vertical gauge face of running rail; and double railheads as the switch and stock rails diverge. As the switch and stock rails diverge, the stock rail moves out of view of the system until the closure rail is the only image in view. The direction of the divergence of the switch could be determined by various methods, including, but not limited to, 1) finding a chamfered rail that indicates a location near a switch point, or 2) noting that the railhead width increases as the switch and stock rails diverge.

Since all rail profiles are tagged with GPS coordinates, the location of the profile closest to the switch point could be cross-referenced in a connected database that listed the names, locations, and properties of all switches on a railway's system so the appropriate standard is applied to the switch. In addition, identifying the exact switch would allow continuous monitoring of switch condition over time, so that changes in the condition over time could be found, alerting a maintenance crew to proactively repair a switch that is close to being in a hazardous condition.

An aspect of making measurements to a rail is to know the original rail section. For switch rails, this is rather complicated since the shape is not regular and additional components of the switch may appear in the field of view in the profile, thus obscuring the bottom portion of the rail needed to determine rail height and web width. If the switch is known, the rail section can be determined by a connected reference database, or it can be deduced by the running rail immediately before and after the switch, which should be (but is not necessarily) the same. In addition to knowing the rail section, aligning the original rail section to the stock rail, which is rather straightforward for a running rail, is much more difficult for a switch rail since the bottom portion of the rail is not visible. Obtaining a correct alignment is important for determining measurements such as gauge side wear and vertical wear of the stock rail.

Another useful initial step in this process is applying the virtual gauges to determine if they are in violation of any of the derailment hazard conditions from any rail standards, including the Network Rail standard NR/L2/TRK/0053. Additionally, the gauge face angle of the switch rail is a relatively simple calculation. While there are definite challenges associated with the irregularity of the switch rail profile, the simple design of these gauges will allow them to be used effectively as virtual gauges.

Applying the virtual gauges, which match current or future measurement inspection gauges, and making other key rail-related measurements of the switch rail and frog, has proven to be an effective way to evaluate the condition of switches and frogs. This is especially important, since there are a large number of hazardous conditions near a switch point that could result in a train derailment. This inspection and analysis enables a large number of switches and frogs to be measured in the field, analyzed, reported and made available for follow-up viewing in an office setting. Individual rail profiles can be evaluated with each of the virtual gauges, and images of the rail overlaid with the gauges can be saved. The series of profiles constituting a switch or a frog can be drawn together to approximate a 3-dimensional view of the switch or frog, which allows a more comprehensive view of the switch and how its condition varies along the closed switch blade or frog. In addition, measuring the same switch or frog regularly will allow the deterioration of the switch or frog to be monitored closely, providing a means to perform proactive, rather than reactive, maintenance on the switch or frog.

The method and software disclosed herein are part of a viable system for identifying certain classes of switch rail conditions which can lead to derailments, and for enhancing the switch inspection approach currently used. The use of this method and software as an integrated part of the rail profile monitoring program will reduce reliance on field measurements and will also allow more frequent, comprehensive, and convenient analysis of switch condition.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of inspecting a turnout of a railroad track, the method comprising the steps of:

capturing images of running rail portions and rail components of the turnout;

converting each image into a set of coordinates that traces the transverse cross-section of a profile of the image of each respective running rail portion and each respective component;

analyzing the profile to determine if the profile is a profile of a running rail portion or a rail component;

upon determination that the profile of the image represents a rail component, taking measurements of the profile and applying electronic gauges to the profile to check for safety and/or maintenance issues associated with the rail component, the electronic gauges may be rotated or translated to be applied at appropriate positions and location of the rail component to measure the conditions of the rail component to determine if the rail component is approaching or is failing safety and/or maintenance standards;

generating a summary of each cross-section of the profile of the rail component indicating areas in which safety and/or maintenance issues exist.

2. The method of inspecting the turnout of the railroad track as recited in claim 1 whereby the analyzing of the rail profile and the generation of the summary occur offline.

3. The method of inspecting the turnout of the railroad track as recited in claim 1 whereby the analyzing of the rail profile and the generation of the summary occur in real-time.

4. The method of inspecting the turnout of the railroad track as recited in claim 1 whereby the images are captured from a moving train at intervals of less than six inches.

5. The method of inspecting the turnout of the railroad track as recited in claim 1 whereby the rail component is a switch rail.

6. The method of inspecting the turnout of the railroad track as recited in claim 1 whereby the rail component is a frog.

7. The method of inspecting the turnout of the railroad track as recited in claim 1 whereby the precise location of each respective image is obtained and associated with the respective image to allow image and its respective coordinates to be identified to a specific and exact location of the track.

8. The method of inspecting the turnout of the railroad track as recited in claim 1 whereby the summary generated of each cross-section of the profile of the rail component will visually indicate the areas in which safety and/or maintenance issues exist.

9. A method of inspecting a switch rail of a railroad track, the method comprising the steps of:

capturing images of the switch rail;

converting each image into a set of coordinates that traces the transverse cross-section of a profile of the switch rail;

applying data analysis logic to check that the shape the profile of the switch rail is consistent with expected profile shapes of the switch rail;

applying data quality filters to the coordinates to remove stray points, lines, and other extraneous data points captured in the image;

overlaying the coordinates of a profile of an original section as a reference over the coordinates of the profile of the image;

comparing measurements of the profile of the image of the switch rail to the profile of the original section;

applying electronic gauges to the profile of the switch rail to check for conditions of safety and/or maintenance issues associated with the switch rail;

rotating or translating the electronic gauges to be applied at appropriate positions and location of the switch rail to measure the conditions of the switch rail to determine if the switch rail is approaching or is failing safety and/or maintenance standards;

using the measurements and the gauge readings to determine if the switch rail has areas in which safety and/or maintenance issues exist;

generating a summary of each cross-section of the profile of the switch rail indicating the areas in which safety and/or maintenance issues exist.

10. The method of inspecting the switch rail as recited in claim 9 wherein the application of the data analysis logic checks that the shape of the profile is consistent with expected profile shape of the switch rail spaced from a stock rail indicating that the switch rail is in an open position relative to the stock rail.

11. The method of inspecting the switch rail as recited in claim 10 comprising the additional steps applying data analysis logic to determine if both the switch rail and stock rail are both within the image and wherein the coordinates overlaid are of a profile of an original open section as a reference over the coordinates of the profile of the image.

12. The method of inspecting the switch rail as recited in claim 9 wherein the application of the data analysis logic checks that the shape of the profile is consistent with expected profile shape of the switch rail in close proximity to a stock rail indicating that the switch rail is in a closed position relative to the stock rail and wherein the coordinates overlaid are of a profile of an original closed section as a reference over the coordinates of the profile of the image.

13. The method of inspecting the switch rail as recited in claim 9 wherein the gauges are a set of coordinate points which can be translated to be applied at the appropriate position and location of the image, whereby the gauges provide the ability to measure how close the switch rail is to failing safety and/or maintenance standards.

14. The method of inspecting the switch rail as recited in claim 9 whereby the precise location of each respective image is obtained and associated with the respective image to allow image and its respective coordinates to be identified to a specific and exact location of the track.

15. The method of inspecting the switch rail as recited in claim 9 whereby the overlaying of the coordinates, the comparing of the measurements, the applying of the gauges and the generation of the occur in real-time.

16. A method of inspecting a frog of a railroad track, the method comprising the steps of:

capturing images of the frog;

converting each image into a set of coordinates that traces the transverse cross-section of a profile of the frog;

applying data analysis logic to check that the shape the profile of the frog is consistent with expected profile shapes of the frog;

applying data quality filters to the coordinates to remove stray points, lines, and other extraneous (non-essential) data points captured in the image;

setting the profile of the frog to a fixed reference point;

comparing measurements of the profile of the image of the frog to a profile of an original section;

applying electronic gauges to the profile of the frog to check for conditions of safety and/or maintenance issues associated with the frog;

rotating or translating the electronic gauges to be applied at appropriate positions and location of the frog to measure the conditions of the frog to determine if the frog is approaching or is failing safety and/or maintenance standards;

using the measurements and the gauge readings to determine if the frog has areas in which safety and/or maintenance issues exist;

generating a summary of each cross-section of the profile of the frog indicating the areas in which safety and/or maintenance issues exist.

17. The method of inspecting the frog as recited in claim 16 wherein the gauges are a set of coordinate points which can be translated to be applied at the appropriate position and location of the image, whereby the gauges provide the ability to measure how close the frog is to failing safety and/or maintenance standards.

18. The method of inspecting the frog as recited in claim 17 whereby the precise location of each respective image is obtained and associated with the respective image to allow image and its respective coordinates to be identified to a specific and exact location of the track.

19. The method of inspecting the frog as recited in claim 17 whereby the setting of the profile of the frog, the comparing of the measurements, the applying of the gauges and the generation of the occur in real-time.

20. A method of inspecting a railroad track, the method comprising the steps of:

capturing images of portions of a rail;

converting each image into a set of coordinates that traces the transverse cross-section of a profile of each respective image of the rail;

applying virtual electronic gauges to each respective profile to check for safety and/or maintenance issues associated with the rail, the virtual electronic gauges may be rotated or translated to be applied at appropriate positions and location of the rail to measure the conditions of the rail to determine if the rail is approaching or is failing safety and/or maintenance standards.

* * * * *